US005806415A

United States Patent [19]

Lipponen et al.

[11] Patent Number: 5,806,415

[45] Date of Patent: Sep. 15, 1998

[54] METHOD FOR QUICK-OPENING A SET OF ROLLS IN A CALENDER, IN PARTICULAR IN A SUPERCALENDER, AND A HYDRAULIC SYSTEM FOR A SET OF ROLLS IN A CALENDER, IN PARTICULAR A SUPERCALENDER

[75] Inventors: Juha Lipponen, Palokka; Pekka Koivukunnas; Aaron Mannio, both of Järvenpää, all of Finland

[73] Assignee: Valmet Corporation, Helsinki, Finland

[21] Appl. No.: 852,107

[22] Filed: May 6, 1997

[30] Foreign Application Priority Data

May 6, 1996 [FI] Finland ..... 961912

[51] Int. Cl.[6] ..... D21G 1/00

[52] U.S. Cl. ..... 100/35; 100/47; 100/163 A

[58] Field of Search ..... 100/35, 47, 161–170; 72/232, 234

[56] References Cited

U.S. PATENT DOCUMENTS

| | | | |
|---|---|---|---|
| 3,584,570 | 6/1971 | Sass et al. . | |
| 3,884,140 | 5/1975 | Christ et al. . | |
| 4,290,351 | 9/1981 | Pav et al. . | |
| 4,510,859 | 4/1985 | Berry . | |
| 4,627,262 | 12/1986 | Tödter . | |
| 4,736,678 | 4/1988 | Stotz | 100/163 A |
| 4,838,156 | 6/1989 | Hafner et al. | 100/163 A |
| 4,890,551 | 1/1990 | Dahl et al. . | |
| 4,901,637 | 2/1990 | Hagel et al. . | |
| 4,924,772 | 5/1990 | Schlunke et al. . | |
| 4,967,653 | 11/1990 | Hinz . | |
| 5,038,678 | 8/1991 | Honkala et al. . | |
| 5,154,799 | 10/1992 | Vallius . | |
| 5,336,074 | 8/1994 | Kashiwa et al. . | |
| 5,438,920 | 8/1995 | Koivukunnas et al. . | |
| 5,443,000 | 8/1995 | Wenzel | 100/163 A |
| 5,662,037 | 9/1997 | Van Haag | 100/163 A |

FOREIGN PATENT DOCUMENTS

| | | | |
|---|---|---|---|
| 851465 | 9/1970 | Canada | 100/47 |
| 55373 | 3/1979 | Finland . | |
| 880785 | 10/1988 | Finland . | |
| 79574 | 9/1989 | Finland . | |
| 83346 | 3/1991 | Finland . | |
| 935214 | 11/1993 | Finland . | |
| 94067 | 3/1995 | Finland . | |
| 2845055 | 4/1980 | Germany . | |
| 3713560 | 11/1988 | Germany . | |

*Primary Examiner*—Stephen F. Gerrity
*Attorney, Agent, or Firm*—Steinberg & Raskin, P.C.

[57] ABSTRACT

A method for quick-opening a set of rolls in a calender, in particular a supercalender, in which a paper or board web to be calendered is passed through calendering nips formed by a variable-crown top roll, a variable-crown bottom roll and by two or more intermediate rolls arranged between the top and bottom rolls. The rolls are arranged to form a substantially vertical stack of rolls, and the intermediate rolls are supported by the use of hydraulic relief cylinders so as to relieve the nip load produced by the mass of the bearing housings of the intermediate rolls and auxiliary devices associated therewith. During the quick-opening of the set of rolls, the bottom roll of the set of rolls is lowered and the relief pressures in the hydraulic relief cylinders are discharged so as to open the calendering nips. The hydraulic oil flowing out from the relief cylinders is controlled by valves connected to the relief cylinders of each intermediate roll so that, during quick-opening of the set of rolls, the roll nips may be opened in a controlled manner in a desired order. A hydraulic system for the set of rolls is also disclosed.

20 Claims, 6 Drawing Sheets

METHOD FOR QUICK-OPENING A SET OF ROLLS IN A CALENDER, IN PARTICULAR IN A SUPERCALENDER, AND A HYDRAULIC SYSTEM FOR A SET OF ROLLS IN A CALENDER, IN PARTICULAR A SUPERCALENDER

FIELD OF THE INVENTION

The invention relates to a method for quick-opening a set of rolls in a calender, in particular a supercalender, in which a paper or board web to be calendered is passed through calendering nips formed by a variable-crown top roll, a variable-crown bottom roll and by two or more intermediate rolls arranged between the top and bottom rolls. The rolls are arranged to form a substantially vertical stack of rolls. In the calender, the intermediate rolls are supported by means of hydraulic relief cylinders so as to relieve the nip load produced by the mass of the bearing housings of the intermediate rolls and auxiliary devices associated therewith, and in which case, during the quick-opening of the set of rolls, the bottom roll of the set of rolls is lowered and the relief pressures in the hydraulic relief cylinders are discharged partially or completely so as to open the calendering nips.

The invention also relates to a hydraulic system for a set of rolls in a calender, in particular a supercalender, comprising a variable-crown top roll, a variable-crown bottom roll and two or more intermediate rolls arranged between the top roll and the bottom roll, which rolls are arranged to form a substantially vertical stack of rolls, the rolls placed one above another in the set of rolls and adjacent rolls being in nip contact with one another and forming calendering nips therebetween. In the set of rolls, the intermediate rolls are provided with hydraulic actuators, in particular with relief cylinders, so as to relieve the nip load produced by the mass of the bearing housings of the intermediate rolls and auxiliary devices associated therewith, such as, take-out rolls and equivalent, in which case, during operation, the hydraulic system is arranged to supply hydraulic oil to the relief cylinders under a desired pressure through valves.

BACKGROUND OF THE INVENTION

The set of rolls in a supercalender conventionally comprises a plurality of rolls which are arranged one above the other as a stack of rolls. The rolls are placed one above another and adjacent rolls in the stack are in nip contact with one another, and the paper or board web or equivalent to be calendered is arranged to run through the nips between the rolls. The rolls are journalled revolvingly on bearing housings, which in turn are normally attached to base parts fitted slidably on vertical guides provided in the frame of the calender. The base parts are suspended through stop parts on vertical lifting spindles provided in the frame of the calender, one of the functions of these lifting spindles thus being to act as guides to keep the rolls of the set of rolls in a correct position. Thus, the rolls of the set of rolls are not rigidly fixed at their bearing housings to the frame of the calender, but, instead, the rolls can move in a vertical direction.

The mass of the bearing housings of the rolls and the auxiliary devices attached thereto, such as, take-out rolls, are quite large, and as such, cause in conventional supercalenders the considerable drawback of distortions in the distributions of the linear loads of the nips. For this reason, supercalenders have started to incorporate relief devices which are supported on the base parts of the rolls, on one hand, and on spindle nuts provided on the lifting spindles, on the other hand. In this manner, distortions caused by the weight of the bearing housings of the rolls and the auxiliary devices attached thereto in the linear load profiles between the rolls can be relieved by means of relief devices. One such arrangement has been previously disclosed, inter alia, in U.S. Pat. No. 4,901,637, incorporated entirely by reference herein. The use of relief devices is previously known also from conventional machine calenders, in which attempts are made to eliminate, in particular, by means of hydraulic relief cylinders, the above-mentioned effect of concentrated loads arising from the bearing housings of the rolls and from auxiliary devices.

In conventional sets of rolls of supercalenders provided with a lifting spindle, in connection with the quick-opening of the set of rolls, the rolls fall so as to rest on a nut of the lifting spindle situated below a bracket of the base part of the bearing housing. The quick-opening of the set of rolls has been carried out, as a rule, in such a way that the pressure has been discharged out from the lifting cylinder of the bottom roll in the set of rolls. In a similar way, in the case where as the bottom roll is used a roll which is adjustable in zones and in which the roll mantle is able to move over its entire length in a radial direction relative to the axle of the roll, the pressures have been discharged out from the loading members of the roll mantle so that the roll mantle has substantially moved relative to the axle of the roll, thereby allowing the intermediate rolls of the set of rolls to "fall" a certain distance downwards together with the roll mantle of the bottom roll. The movement of the lower intermediate rolls has been larger than the movement of the upper intermediate rolls in order to provide a gap of substantially equal size between the rolls. For this reason, the opening of the nips of the set of rolls has not been simultaneous, but, instead, the opening of the set of rolls has started from the uppermost nip, proceeding as a successive process towards the lowermost nip in the stack. This has usually taken place irrespective of whether or not any relief devices have been used in connection with the intermediate rolls. Additionally, the opening distances have been previously quite considerable because supercalenders previously employed fiber rolls, or so-called filled rolls, as soft rolls. The opening of the nips at different times has caused the considerable disadvantage that there have been substantial variations in the tension of the web and, consequently, there have always occurred web breaks in quick-opening. The broken end of paper has in turn run through the closed nips, which has resulted in the marking of soft rolls, which has further caused that the quality of paper has been completely spoiled, unless the marked roll has been replaced immediately.

New supercalenders have begun to employ polymer rolls as soft rolls instead of fiber rolls, whereupon the total height variation of the set of rolls has remained considerably smaller than in conventional supercalenders that use filled rolls. One reason for this reduced total height variation has been the fact that variations in the diameters of soft rolls have been very small because the grinding allowances of these rolls are small. This reduced total height variation has in turn led to the fact that it has been possible to omit altogether the lifting spindles and the glide guides associated with conventional sets of rolls in a supercalender, and it has been possible to replace this construction with a so-called articulated set of rolls, where the intermediate rolls of the set of rolls are mounted on the frame of the calender by means of articulated arms pivotally mounted on the frame. It has been possible to do so for the reason that, since the variations of the total height of the set of rolls are small, the vertical distance of movement required by an individual roll is small, and because of this, irrespective of the articulated attachment mode, the movements of the rolls relative to the nip level have also been very small when adjusting the height position of the roll.

One such very developed articulated set of rolls is disclosed, inter alia, in Finnish patent application Ser. No. 935214, corresponding to U.S. Pat. No. 5,438,920, incorporated entirely by reference herein. However, the problem also with this kind of supercalender has been to make the nips of the set of rolls open simultaneously during quick-opening of the set of rolls.

OBJECTS AND SUMMARY OF THE INVENTION

Accordingly, it is an object of the present invention to provide a method and a system by which the nips of the set of rolls can be opened in a controlled and desired manner in the order desired during quick-opening, preferably such that the nips open simultaneously during quick-opening.

It is another object of the invention to provide a new and improved method for quick-opening a set of rolls forming a calender, in particuliar supercalendar, in which drawbacks of prior art methods are avoided.

With a view to attaining the objects of the invention set forth above, and others, in the method according to the invention, the hydraulic oil flowing out from relief cylinders is controlled by means of valves connected to the relief cylinders of each intermediate roll so that, during the quick-opening of the set of rolls, the roll nips may be opened in a controlled manner in a desired order.

The hydraulic system according to the invention is arranged to supply relief cylinders with a hydraulic pressure which depends on the load acting on them and which pressure can, during the quick-opening of the set of rolls when the bottom roll in the stack of rolls has been lowered, be discharged from the relief cylinders of the intermediate rolls in a controlled manner so that the calendering nips in the set of rolls may be opened in a desired order.

The invention provides significant advantages over prior art arrangements and of these advantages, among other things, the following may be stated. The quick-opening operation has been accomplished in the invention most advantageously completely hydraulically so that the nips may be opened in a desired manner and quickly. In a most advantageous embodiment, the invention is accomplished such that the nips open simultaneously. For instance, in a web break situation the simultaneous and quick opening of the nips is of crucial importance, because in supercalenders the quick-opening should, as a rule, take place even in a shorter time than half a second after a web break has been observed. This can be accomplished by the arrangement of the invention.

In a basic embodiment of the method for quick-opening a set of rolls in a calender in accordance with the invention, the calender includes calendering nips through which a paper or board web to be calendered is passed, and which are formed by a variable-crown upper roll, a variable-crown lower roll and at least two intermediate rolls arranged between the upper and lower rolls. The upper roll, the lower roll and the intermediate rolls form a substantially vertical stack of rolls whereby the intermediate rolls are supported by relief cylinders pressurized by hydraulic fluid so as to relieve the nip load produced by the mass of bearing housings of the intermediate rolls and auxiliary devices associated therewith. During quick-opening of the set of rolls, the lower roll is lowered and the relief pressures in the relief cylinders are at least partially discharged to open the calendering nips. The method entails connecting valves to the relief cylinders of the intermediate rolls, each valves having a flow passage through which hydraulic fluid flows, and operating the valves to control the flow of hydraulic fluid from the relief cylinders through the flow passages in the valves to thereby discharge the relief pressures in the relief cylinders and such that the calendering nips are opened in a controlled manner and in a desired order during quick-opening of the set of rolls. The operation of the valves may entail opening all of the valves substantially simultaneously such that hydraulic fluid from the relief cylinders flows through the flow passages in all of the valves and/or controlling the flow of hydraulic fluid through the flow passages in the valves such that the hydraulic fluid flows in a path downward from each of the intermediate rolls to the intermediate rolls situated below that intermediate roll and varying the flow resistance of the hydraulic fluid from the relief cylinders of the intermediate rolls. This variation may be achieved such that the flow resistance of the hydraulic fluid from the relief cylinder supporting an uppermost one of the intermediate rolls is the highest and the flow resistance of the hydraulic fluid from the relief cylinders supporting the remaining ones of the intermediate rolls decreases for each of the intermediate rolls below the uppermost intermediate roll, the flow resistance of the hydraulic fluid from the relief cylinder supporting the lowermost one of the intermediate rolls being the lowest.

Another possible operation of the valves entails controlling the flow of hydraulic fluid through the valves such that the hydraulic fluid flows in a path downward from one of the valves associated with each of the intermediate rolls through other of the valves associated with other ones of the intermediate rolls situated below that intermediate roll during quick-opening of the set of rolls. In this manner, the pressure of the relief cylinder supporting an uppermost one of the intermediate rolls is discharged through all of the valves and the pressure of the relief cylinder supporting a lowermost one of the intermediate rolls is discharged only through its own valve. A hydraulic fluid may be directed through a control valve to all of the valves of the relief cylinders of the intermediate rolls to provide a control impulse simultaneously to all of the valves of the relief cylinders of the intermediate rolls in order to hydraulically control the same. In some embodiments, a movable piston is arranged in each of the relief cylinders, an end of each piston is coupled to an arm supporting a bearing housing of one of the intermediate rolls such that movement of the piston translates into movement of the intermediate rolls, movement of the pistons in the relief cylinders is slowed and optionally stopped during quick-opening of the set of rolls once a desired quick-opening distance has been reached.

In one embodiment of the hydraulic system in accordance with the invention for a set of rolls in a calender described above, there are valves for supplying hydraulic fluid to the relief cylinders under a desired pressure during operation which depends on the load acting on each of the relief cylinders, the valves discharging the hydraulic pressure from the relief cylinder during quick-opening of the set of rolls when a lowermost roll in the stack of rolls is lowered, and control means associated with the valves for controlling the discharge of hydraulic pressure from the relief cylinders through the valves. The hydraulic pressure is discharged from the relief cylinders in a controlled manner and the calendering nips in the set of rolls open in a desired order.

Further advantages and characteristic features of the invention come out from the following detailed description of the invention.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
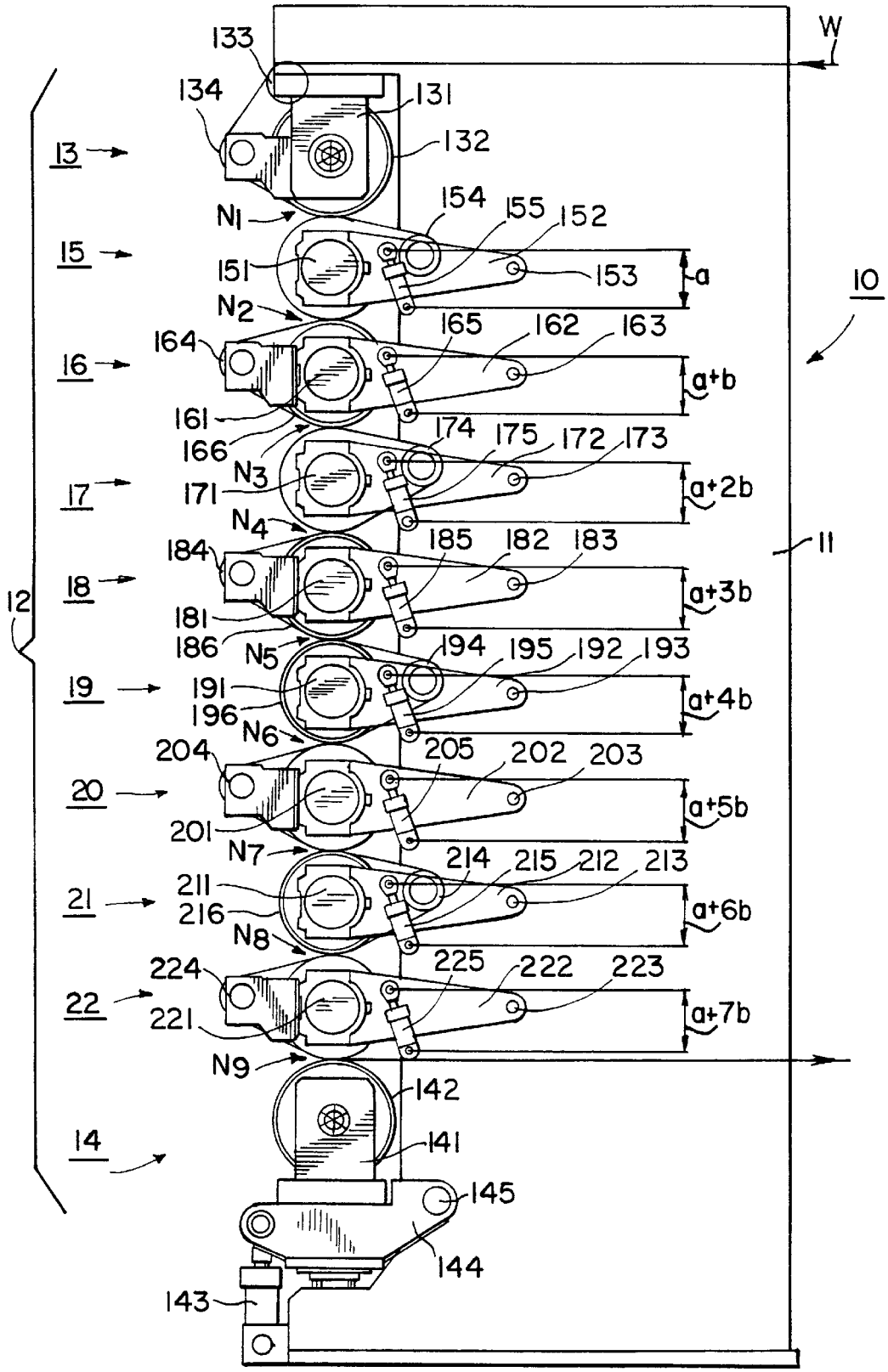
FIG. 1 is a schematic side view of a calender in which the method and the system in accordance with the invention are applied.

Referring to FIGS. 1–5C wherein like reference numerals refer to the same or similar elements, FIG. 1 is a schematic side view of a supercalender in which the method and the system in accordance with the invention are applied. The supercalender in FIG. 1 is denoted generally by reference numeral 10, and it comprises a calender frame 11, in which a stack of rolls 12 consisting of a number of rolls has been mounted in a substantially vertical plane. The stack of rolls 12 comprises a top or upper roll 13, a bottom or lower roll 14, and a number of intermediate rolls 15–22 (at least two) arranged one above the other between the top roll 13 and the bottom roll 14. The intermediate rolls 15–22 are each arranged in such a way that they are in nip contact with the adjacent rolls in a running situation. FIG. 1 shows the stack of rolls 12 of the calender expressly in the running position (when a web is being calendered). A paper or board web W is passed in the example shown in FIG. 1 over a spreader roll 133 and a take-out roll 134 into an upper nip $N_1$, and further through other nips $N_2$–$N_8$ in the calender and finally out from a lower nip $N_9$. Between the nips $N_1$–$N_9$, the paper or board web W is taken apart from the face of the rolls by means of take-out rolls 154,164,174,184,194,204,214,224. As shown in FIG. 1, the take-out rolls are situated alternatingly "outside" (take-out rolls 164,184,204,224) and "inside" (take-out rolls 154,174,194,214) the stack of rolls relative to the calender frame 11.

The top roll 13 in the calender is a variable-crown roll including a bearing housing 131 at each end which, in the embodiment of FIG. 1, is attached directly and rigidly to the calender frame 11. The axle of the variable-crown top roll 13 is mounted in the bearing housings 131, and the roll is provided, in a normal manner, with internal loading means by which the deflection of the roll mantle may be regulated in a desired way. The top roll 13 is a so-called soft roll and it is provided with a resilient polymer coating 132.

In a similar manner, the bottom roll 14 in the calender is a variable-crown roll, whose roll mantle is mounted rotatably on the roll axle and which roll 14 is provided with internal loading means by which the deflection of the roll mantle can be regulated in a desired manner. The axle of the bottom roll 14 is mounted in bearing housings 141, which in the embodiment of FIG. 1 are mounted on loading arms 144, which are linked by means of articulated joints 145 to the calender frame 11. Between the calender frame 11 and the loading arms 144, there are mounted lower cylinders 143 by whose means the bottom roll 14 can be displaced in a vertical plane. Thus, the loading of the nips $N_1$–$N_9$ in the stack of rolls 12 can be provided by means of the lower cylinders 143 and, further, the stack of rolls 12 can be opened (separated from one another), if needed, by means of the lower cylinders 143. The internal loading means of the top roll 13 may also participate in the loading of the nips $N_1$–$N_9$ in the stack of rolls. Owing to the variable-crown bottom roll 14, the profiles of linear loads can be kept substantially uniform in the nips $N_1$–$N_9$ in the stack of rolls 12. In the example of FIG. 1, the bottom roll 14 is also provided with a polymer coating 142 corresponding to that of the top roll 13.

The intermediate rolls 15–22 in the stack of rolls 12 consist alternately of hard-faced and soft-faced rolls in such a way that in all the nips, except for the middle nip $N_5$, of the stack of rolls 12, one of the rolls is a hard-faced roll and the roll forming a nip therewith is a soft-faced roll. By soft-faced calender rolls are meant both modern rolls provided with a thin polymer coating and rolls provided with a coating made of a sheet material by pressing in an axial direction and conventionally used in the supercalender. The middle nip $N_5$ in the stack of rolls 12 is a so-called soft nip, in which both of the rolls forming the nip are soft-faced rolls. Thus, as the top roll 13 in the stack of rolls is a soft-faced roll, the uppermost intermediate roll 15 is a hard-faced roll. In a corresponding manner, the second uppermost intermediate roll 16 is a soft-faced roll provided with a resilient polymer coating 166 and, further, the following intermediate roll 17, or the third intermediate roll from the top, is a hard-faced roll. As stated above, the rolls 18 and 19 forming the middle nip $N_5$ are soft rolls provided with a resilient polymer coating 186,196, the next roll 20 downwards being again a hard-faced roll. The second lowest intermediate roll 21 is a roll provided with a polymer coating 216 and the lowermost intermediate roll 22 is a hard-faced roll. Other configurations of soft-faced rolls and/or hard-faced rolls in the stack of a calender or supercalender can also be applied without deviating from the scope and spirit of the invention.

In the calender shown in FIG. 1, bearing housings 151, 161,171,181,191,201,211,221 of each intermediate roll 15–22 in the stack of rolls 12 are mounted on arms 152, 162,172,182,192, 202,212,222, which are linked pivotally on the calender frame 11 by means of articulated joints 153,163,173,183,193,203,213 and 223 parallel to the axis of the rolls. The arms 152,162,172, 182,192,202,212 and 222 are provided with respective relief devices 155,165,175,185, 195,205, 215 and 225, which are pressure-medium operated piston-cylinder devices, most advantageously, hydraulic cylinders, which are attached at one end thereof to the respective arms of the intermediate rolls 15–22 and at the opposite end thereof to the calender frame 11. The so-called journal loads of the intermediate rolls, i.e., the loads caused by the bearing housings of the intermediate rolls 15–22 and by the auxiliary devices attached to the bearing housings, can be relieved by means of the relief devices. The required relief forces are of different magnitude on the different intermediate rolls 15–22 since, as stated above, the take-out rolls, which are attached to the bearing housings of the intermediate rolls 15–22, are situated alternately on the inside and on the outside of the nip plane relative to the calender frame 11, and thus the loading caused by them on the relief devices is of different magnitude.

It has also already been stated above that in a situation where the stack of rolls is quickly opened, the rolls 13–22 in the stack of rolls must be detached from one another in such a way that each of the nips $N_1N_9$ opens, preferably an equal distance. In FIG. 1, which thus shows the calender 10 in a running position with the nips $N_1N_9$ closed, attempts are made to illustrate this in such a way that the length of the relief device 155 of the topmost intermediate roll 15, i.e., the length of a projecting piston rod of a hydraulic cylinder, is denoted by reference sign a. The size of the gap between the rolls required in quick-opening is in turn denoted by reference sign b in FIG. 1. Consequently, the length of the projecting piston rod in the hydraulic relief device 165 of the second highest intermediate roll 16 must be a+b.

In a similar manner, in the direction downwards in the stack of rolls 12, the length of the projecting piston rod in the relief device of each intermediate roll must be greater by the distance b than the length of the piston rod in the relief device situated immediately above so that in the calender 10 shown in FIG. 1 comprising eight intermediate rolls, the length of the projecting piston rod in the hydraulic relief device 225 of the lowermost intermediate roll 22 is a+7*b*. In that case, when in a quick-opening situation, the stack of rolls is opened by means of the lower cylinder 143 by lowering the bottom roll 14, there remains a gap of the size of the distance b in each nip $N_1$–$N_9$ when the piston rods of the hydraulic relief devices are at the bottom. Naturally, a gap larger than this may remain in the lowermost nip $N_9$ depending on the extent of the movement of the lower cylinder 143. Thus, during quick-opening the roll under each intermediate roll falls by the distance b more than the roll above. In view of the stresses directed by the quick-opening at the hydraulic relief devices 155,165,175,185,195,205,215 and 225, cushioned hydraulic cylinders must be used as relief devices. The operation of the system during quick-opening is described more closely by means of the hydraulic circuit diagram shown in FIG. 2.

Figure 2:
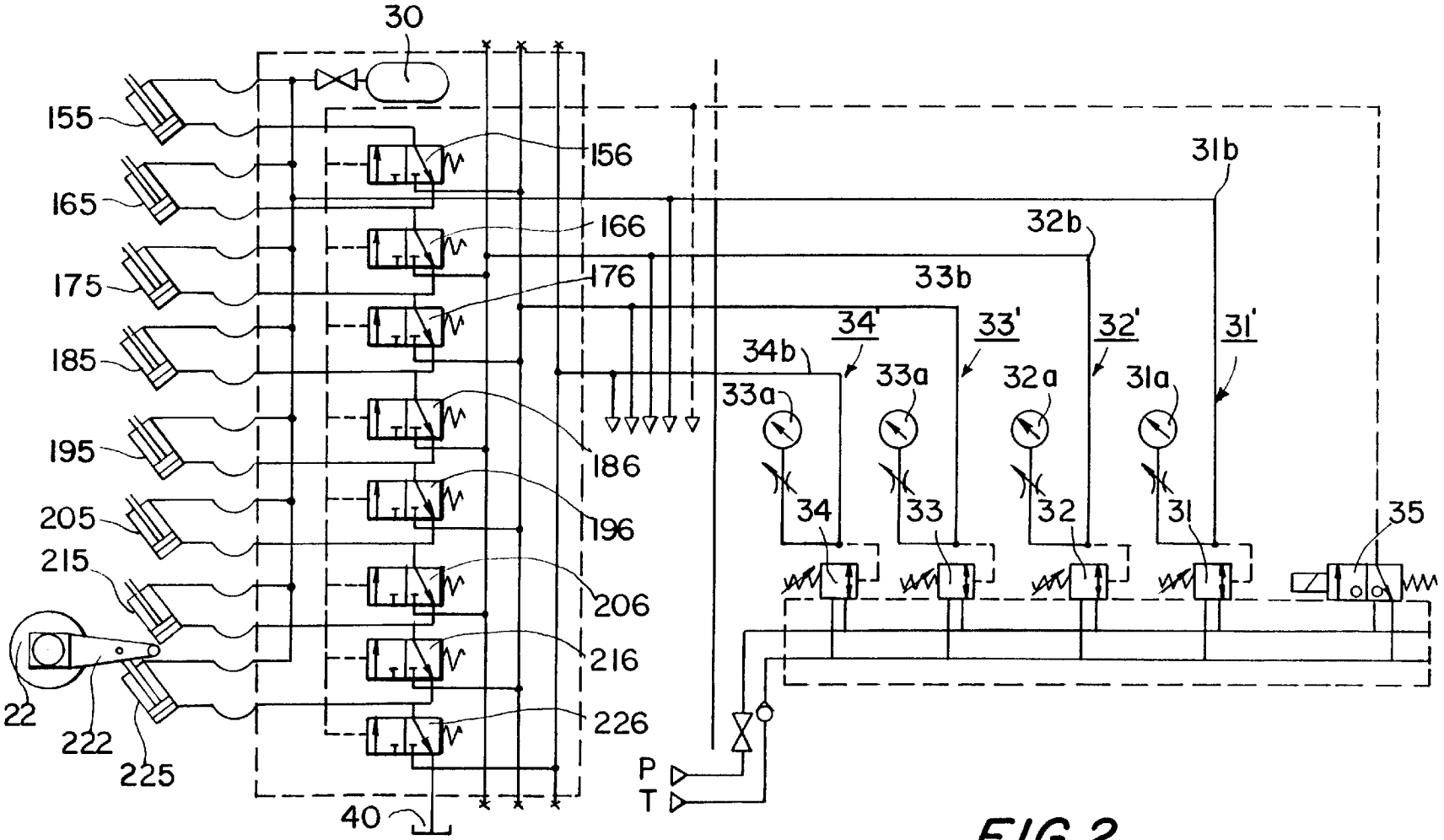
FIG. 2 shows a hydraulic circuit diagram of the system in accordance with the invention in a situation where the calendering nips have been opened.

FIG. 2 thus shows a hydraulic circuit diagram which accomplishes the method and the system in accordance with the invention. As previously stated, the invention primarily relates to the quick-opening of a set of rolls in a calender, and the invention is accomplished in such a way that the internal flow resistance of the hydraulic system is utilized during the quick-opening. The system thus enables the separation of the rolls of the system of rolls from one another as quickly as possible after a quick-opening signal has been received. In FIG. 2, the hydraulic relief devices of the intermediate rolls, i.e., the relief cylinders, are denoted by reference signs 155,165, 175,185,195,205,215 and 225 corresponding to FIG. 1. The diagram drawing shown in FIG. 2 also depicts the lowermost intermediate roll 22 of the set of rolls, which roll is the drive roll of the calender, and the articulated arm 222 of this drive roll, by which it is attached with an articulated joint to the calender frame (not shown in FIG. 2).

The relief cylinders 155, . . . ,225 of the respective intermediate roll in the set of rolls each have a valve of their own, 156,166,176,186,196,206,216 and 226, respectively, through which a required relief pressure is supplied to the relief cylinders in a running situation, and through which valves 156–226, the pressure is discharged from the relief cylinders 155–225 in a situation where the calender is quick-opened. In accordance with FIG. 2, the valves 156–226 are preferably hydraulically-controlled valves, for instance, directional control valves shown therein. The hydraulic circuit diagram of the system is divided, in a way, into four sections such that, first, the hydraulic system comprises a first pressure circuit 31', through which the same filling pressure is supplied to the side of the piston rod of all the relief cylinders 155–225. Thus, the relief cylinders are double-acting hydraulic cylinders, as shown by FIG. 2. The filling pressure is supplied to the side of the piston rod of the relief cylinders mainly for the reason that, in a quick-opening situation, the relief cylinders can be made shorter quickly by the action of the filling pressure when their relief pressure has been discharged.

The first pressure circuit comprises an adjustable valve 31, for instance, a controlled pressure valve, through which pressure is supplied from a pressure supply line of the system to a pressure line 31*b* leading to the side of the piston rod of the relief cylinders 155–225. The first pressure circuit is additionally provided with a pressure gauge 31*a* or equivalent pressure measuring/monitoring device, by which the pressure of the first pressure circuit is monitored. Further, the first pressure circuit is fluidly coupled to a reservoir 30 for a pressure medium, or hydraulic oil, this reservoir being preferably placed at the upper part of the hydraulic system. The purpose of the reservoir 30 is to ensure a sufficiently rapid supply of oil to the side of the rod of the relief cylinders 155–225 in a quick-opening situation.

The hydraulic system comprises, in addition, separate pressure circuits 32', 33', 34' for the relief cylinders 165, 185,205 of the intermediate rolls provided with an external take-out roll, for the relief cylinders 144,175,195,215 of the intermediate rolls provided with an internal take-out roll and separately for the relief cylinder 225 of the lowermost intermediate roll, i.e., the drive roll 22, respectively. These separate pressure circuits are necessary specifically for the reason that, on one hand, the different locations of the take-out rolls produce different loads on the relief cylinders, so naturally it must be possible to load them with a different pressure. On the other hand, the loads directed to the drive roll 22 differ from the load of all the other intermediate rolls, so the drive roll 22 must have a separate pressure circuit of its own. Thus, each of these separate pressure circuits 32', 33', 34' comprises an adjustable valve 32,33,34, which is preferably of a type corresponding to the valve 31 of the first pressure circuit 31', through which valve hydraulic oil from the pressure supply line of the hydraulic system is passed to respective pressure lines 32*b*,33*b*,34*b*. Further, these pressure circuits are provided with pressure gauges 32*a*,33*a*,34*a* or equivalent pressure measuring/monitoring means. Hydraulic oil is passed from the pressure circuits to the relief cylinders 155–225 through the valves 156–226. As previously stated, the valves 156–226 are hydraulically controlled valves and these valves receive their necessary control pressure through a control valve 35, which thus controls jointly all the valves 156–226 of the relief cylinders 155–225.

FIG. 2 specifically shows a quick-opening situation where the pressures have been discharged under the pistons of the relief cylinders 155–225. In such a quick-opening situation, pressure has been removed from the loading cylinder 143 of the bottom roll 14 of the calender, in which case the bottom roll 14 has been lowered. Before the quick-opening situation, the hydraulic system has been in an operation state corresponding to FIG. 2A, where the valve 35 controlling the valves 156–226 of the relief cylinders 155–225 has supplied the hydraulically controlled valves 156–226 with a control pressure, which has maintained the valves against the spring-load of the valves in the position shown in FIG. 2A in such a way that the hydraulic oil has been allowed to get under the piston of the relief cylinders 155–225 through the pressure circuits 32', 33', 34' in order to provide a required relief force. In the quick-opening situation shown in FIG. 2, the valve 35 has moved to the position shown, in which case the control pressure of the valves 156–226 of the relief cylinders 155–225 has discharged and the spring-load of the valves has displaced the valves from the position shown in FIG. 2A to the position shown in FIG. 2, in which the pressure connection from the pressure circuits 32', 33', 34' to the relief cylinders 155–225 has been cut off and, correspondingly, the connection from below the piston of the relief cylinders 155–225 to a reservoir 40 has been opened.

As clearly depicted in FIG. 2, in a quick-opening situation the valves 156–226 of the relief cylinders 155–225 are connected in series in such a way that the hydraulic oil flowing out from each relief cylinder 155–225 is guided through the valve 166–226 of the next relief cylinder below, in which case, in the fashion shown by FIG. 2, the hydraulic oil flowing out from all the relief cylinders 155–225 finally passes through the valve 226 of the relief cylinder 225 of the lowermost intermediate roll, i.e., the drive roll 22. This means that the hydraulic oil flowing out from the relief cylinder 155 of the uppermost intermediate roll 15 meets the highest flow resistance, because the oil flowing out from this relief cylinder has to pass through the valves of the relief cylinders of all the intermediate rolls 15–22. The flow resistance decreases correspondingly in the direction downwards in the set of rolls.

As shown in FIG. 1, in a quick-opening situation the lowest intermediate roll, or the drive roll 22, must perform the largest vertical movement, while the required movement of the uppermost intermediate roll 15 is the smallest. In accordance with the illustration of FIG. 1, the necessary displacement of the intermediate rolls increases in the direction from above downwards. This in turn means that, if it is desired to cause all the nips $N_1$–$N_9$ of the set of rolls to open simultaneously, the opening or falling velocity of the lowest intermediate roll 22 must be the highest and this falling velocity must decrease in the direction upwards in the set of rolls. In the invention, this condition is satisfied because, as already stated above, the rate of the flow out from the relief cylinder 225 of the lowermost intermediate roll 22 is the highest, since the flow resistance is correspondingly the lowest. The flow resistance increases in the direction upwards, in which case the rate of flow of the oil out from the relief cylinders naturally decreases. This, of course, affects linearly the movement velocity of the relief cylinders. Thus, in the arrangement in accordance with the invention, gaps begin to be formed between the rolls 13–22 immediately after the valves 156–226 of the relief cylinders 155–225 have moved from the position shown in FIG. 2A to the position shown in FIG. 2.

Figure 2A:
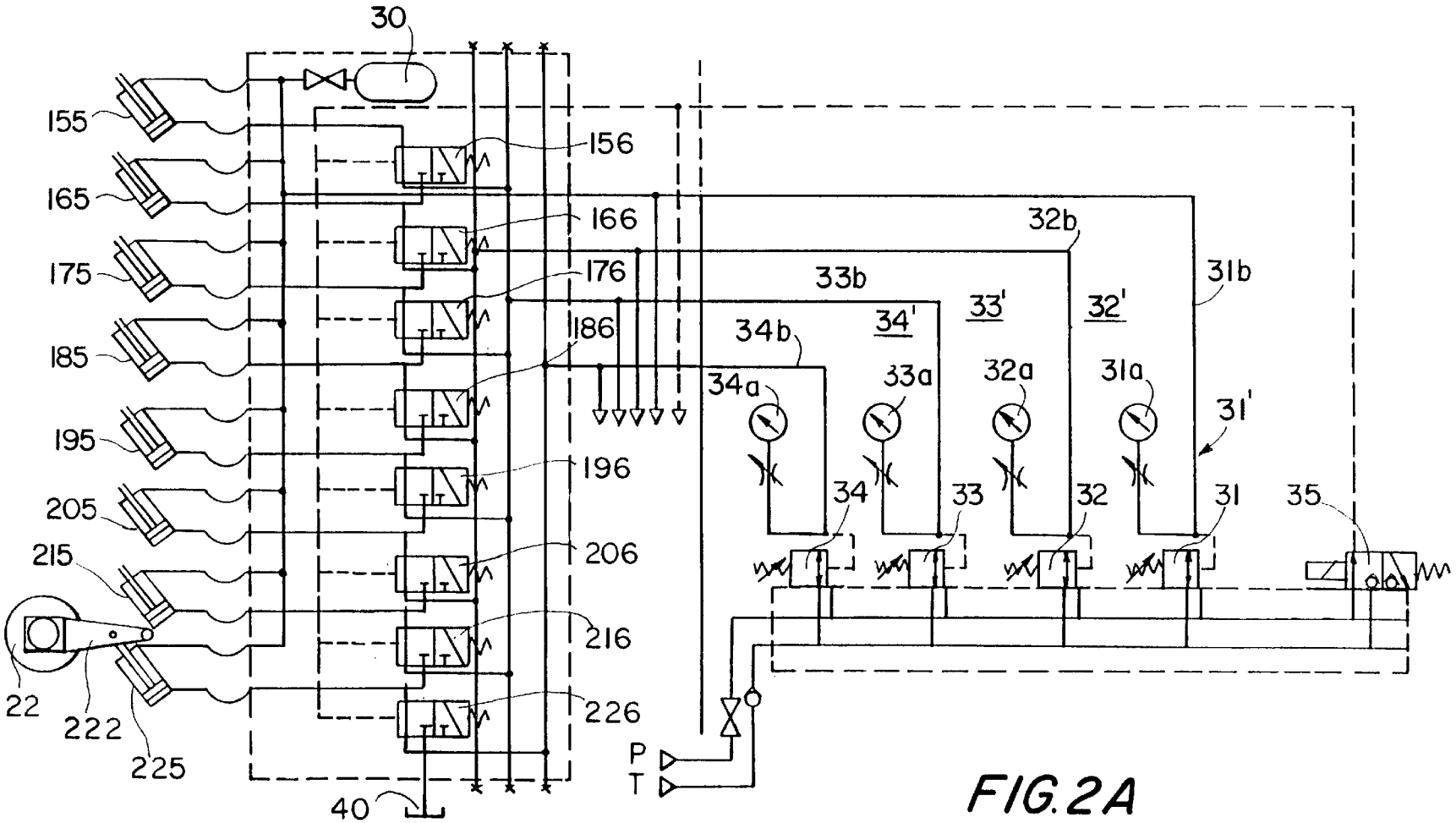
FIG. 2A shows by means of a circuit diagram corresponding to FIG. 2, a calender in a running position with the calendering nips closed.

As the hydraulic drawing sign representing the valve 35 in FIGS. 2 and 2A illustrates, an electromagnetically controlled valve is preferably used as the valve 35. Besides providing a very quick action, the valve 35 can be easily connected electrically in the electric system of the calender 10, for instance, to such an automatic system that identifies web breaks, if such an automatic system is available in the calender.

The above description of the invention has described, with reference to the figures, an arrangement in which the flow resistances in the path of the hydraulic oil flowing out from the relief cylinders 15–225 are arranged in such a way that the calender nips $N_1N_9$ open simultaneously in the entire roll stack 12. It is, however, completely possible to arrange and to regulate the flow resistances in the path of the hydraulic oil flowing out from the relief cylinders 155–225 in such a way that the nips $N_1$–$N_9$ can be caused to open in a controlled way in the order considered to be necessary. However, as stated, the hydraulic circuit described provides the simultaneous opening of the nips.

It is also clear from the above description that in a quick-opening situation, the intermediate rolls 15–22 of the set of rolls have to be supported by the relief cylinders 155–225 in their entirety. Thus, in particular in a quick-opening situation, the relief cylinders are subjected to quite considerable loads, so cylinders provided with cushioning should be used as the relief cylinders. In spite of this, and especially for the reason that the invention provides a very fast opening of the nips $N_1$–$N_9$, it may be necessary to also use a separate stop which is based, for instance, on friction and which receives totally or at least partly the loads arising from quick-opening.

As explained above, it is advantageous to cause the roll nips to open simultaneously in the quick-opening of the set of rolls in a supercalender. In a certain manner, this might be considered problematic because, as it is stated clearly, for instance, in connection with FIG. 1, the opening distances of the roll nips $N_1$–$N_9$ of the set of rolls are unequal in length and because of this, the opening speeds of the nips must also be different. It must be possible to take care of this variation of opening distances and opening speeds by means of the hydraulic system and, in particular, by means of the relief cylinders connected to the hydraulic system. FIGS. 3A–3C, 4A–4C and 5A–5C illustrate some alternative solutions as to how the relief cylinders can be accomplished in a manner fulfilling the requirements imposed on them.

Figure 3A:
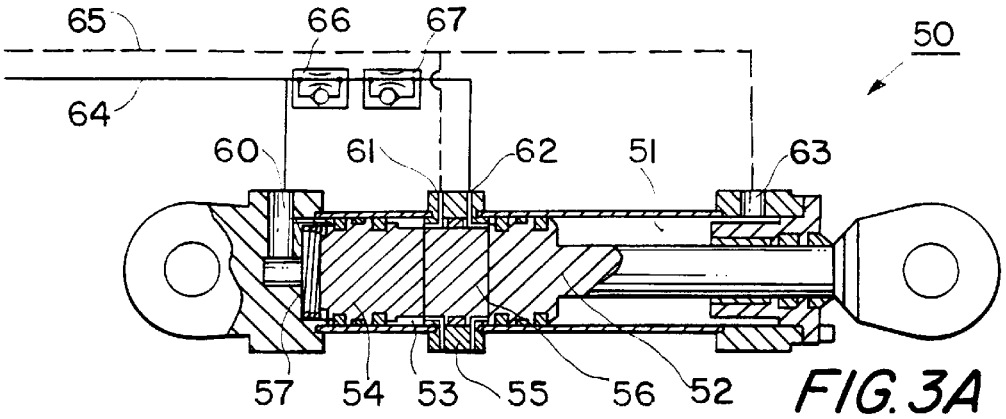
FIGS. 3A–3C, 4A–4C and 5A–5C show some alternative cylinder applications which are suitable for use in the hydraulic system in accordance with the invention in relief cylinders of calender rolls.
Figure 3B:
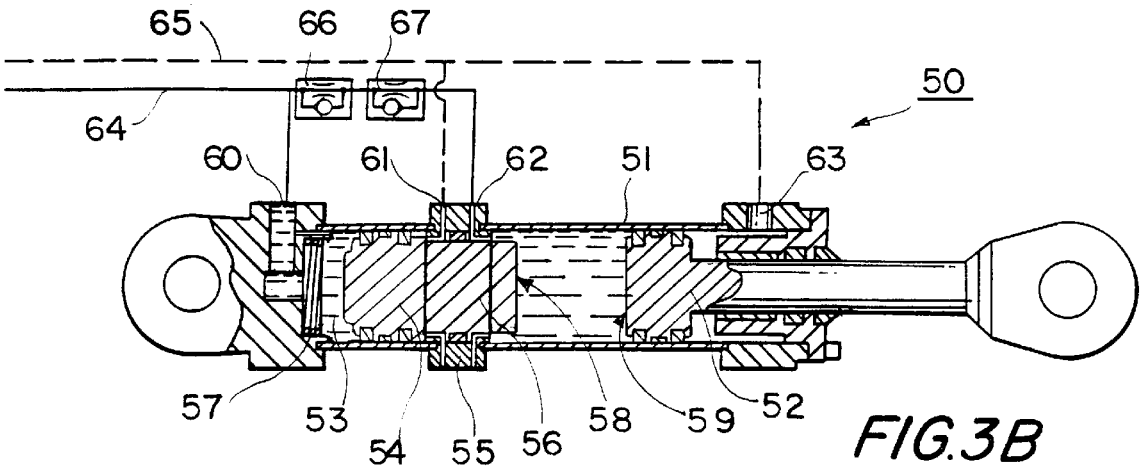
Figure 3C:
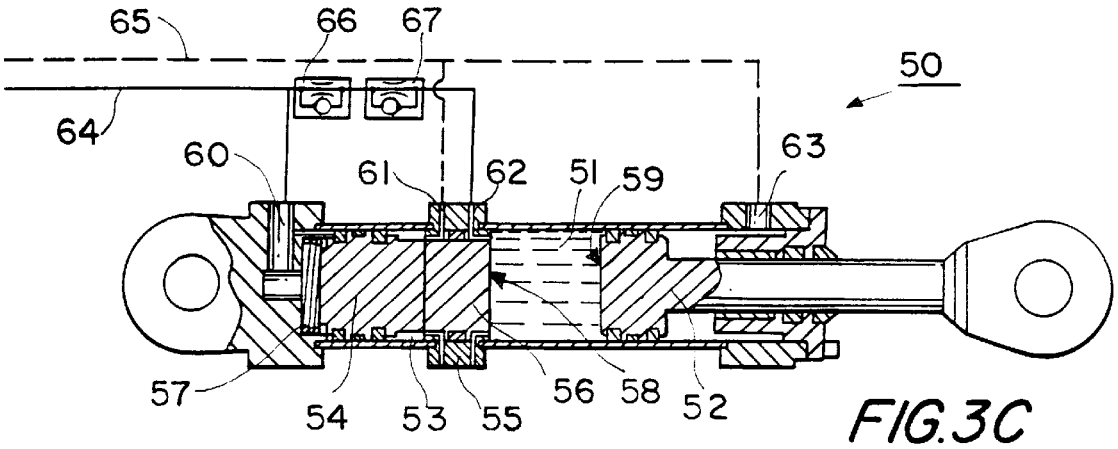

FIGS. 3A–3C show a hydraulic cylinder, which is generally denoted by reference numeral 50, as a first embodiment of a relief cylinder for the invention. Whereas conventional hydraulic cylinders generally comprise two operating positions, for instance, a pressurized working position and an unpressurized free position, the hydraulic cylinder 50 comprises, in addition to these two positions, also a third operating position, which is between these two positions and to which position the hydraulic cylinder can be stopped without complicated control circuits. The hydraulic cylinder 50 comprises a cylinder part 51, inside which a piston 52 is arranged in a normal way so as to be axially movable. The bottom of the cylinder part 51 is replaced by a partition wall 55, through which a special measuring cylinder 53 is connected to the cylinder part 51. A second piston 54, or the piston of the measuring cylinder, is arranged inside the measuring cylinder 53 so as to be also axially movable. In the arrangement shown in FIGS. 3A–3C, the measuring cylinder 53 functions directly as an extension of the cylinder part 51. The partition wall 55 is provided with a large-diameter opening extending therethrough, an extension 56 of the piston of the measuring cylinder being capable of being pushed from the measuring cylinder 53 into the cylinder part 51. Thus, end faces 58,59 of the piston 52 and the piston 54 of the measuring cylinder can be brought against each other so as to be in contact with each other, as illustrated in FIG. 3A. Spring means 57, for instance, a set consisting of cup springs, a spiral spring or equivalent, is arranged on the bottom of the measuring cylinder 53, and the spring means serve as cushioning for the piston 54 of the measuring cylinder 53. The measuring cylinder 53 is provided with a pressure connection 60 and with a drain connection 61 and the cylinder part 51 of the hydraulic cylinder is provided with a pressure connection 62 and with a drain connection 63, respectively. A control pressure 64 of the hydraulic cylinder 50 is passed to these pressure connections 60,62 in such a way that the control pressure is passed to the pressure connection 62 of the cylinder part 51 through valves 66,67, which in the illustration of FIGS. 3A–3C are one-way restrictor valves allowing free flow in one direction and restricting it in the other direction (these directions are opposite in the valves 66,67). Similarly, the drain connections 61,63 are connected to a drain duct 65.

In FIG. 3A, the hydraulic cylinder 50 is shown in an unpressurized state, in which case the piston 52 is pressed to the bottom of the cylinder part 51 by the action of the external load acting on the piston 52. When applied, for instance, to the calender shown in FIG. 1, the situation of FIG. 3A may correspond to a service position, in which case all pressures have been removed from the relief cylinders. As shown in FIG. 3A, the piston 52 is pressed against the piston 54 of the measuring cylinder further in such a way that the piston 54 of the measuring cylinder is pressed against the spring means 57 situated at the bottom of the measuring cylinder 53.

FIG. 3B shows the hydraulic cylinder 50 in its first working position, which, when applied to the calender of FIG. 1, corresponds to the running position of the calender, in which the calendering nips are closed. In that case, oil or another comparable hydraulic fluid has been supplied from the pressure duct 64 through the pressure connection 60 to the measuring cylinder 53 and through the pressure connection 62 to the cylinder part 51. The piston 54 of the measuring cylinder has then moved together with the piston 52 in the illustration of FIG. 3B to the right, or outwards from the cylinder, until the piston 54 of the measuring cylinder has stopped at the partition wall 55 (which stoppage is provided by projections on the circumference of the piston 54). Before resting on the partition wall 55, the piston extension 56 of the measuring cylinder has rested against the piston 52 in such a way that the ends 58,59 of the pistons are against each other to balance pressure forces. This is due to the fact that the same pressure prevails on both sides of the piston 54 of the measuring cylinder and that the area on the side of the partition wall 55 of the piston 54 of the measuring cylinder is smaller. When the pressure has been further increased, hydraulic oil flows between the pistons 52 and 54 through the pressure connection 62, until the piston 52 has reached its extreme position, that is, until an external obstruction has stopped the movement of the piston 52. In the calender, this means precisely the situation shown in FIG. 1, where the nips are closed. FIG. 3C shows a situation where pressure has been removed from the pressure duct 64. When applied to the relief cylinders of the calender, this corresponds to a quick-opening situation. In that case, when pressure has been removed from the duct 64, the piston 54 of the measuring cylinder is immediately pressed to the bottom of the measuring cylinder 53 against the spring means 57 by the action of an external load. The spring means 57 thus provides cushioning in the hydraulic cylinder. The piston 52 of the cylinder part 51 has then naturally moved at the same speed an equivalent distance to the left in FIG. 3C and, if the valve 66 is controlled so as to be closed, the distance between the pistons 54 and 52 remains constant and the piston 52 stops at the position shown in FIG. 3C. Pressure is allowed to discharge freely through the valve 67, since the valve 67 restricts the flow and the pressure only in one direction. If again the valve 66 is not controlled so as to be closed, oil discharges from the cylinder part 51 at a desired speed through the valve 66, until the situation corresponding to FIG. 3A is reached. If the valve 66 is replaced, for instance, by a pressure-controlled lock valve, it is possible to move in both directions between the positions shown in FIGS. 3B and 3C depending on the position of the valve 66 and on the pressure prevailing in the pressure duct 64. The extent of the movement of the piston rod 20 of the piston 52 in the cylinder part 51 between the positions shown in FIGS. 3B and 3C is determined by the play of the piston 54 of the measuring cylinder 53 and by the diameters of the cylinders.

Figure 4A:
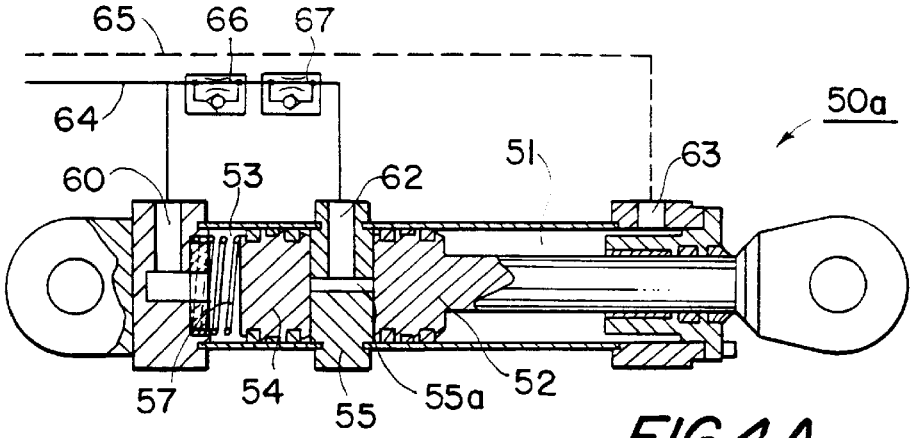
Figure 4B:
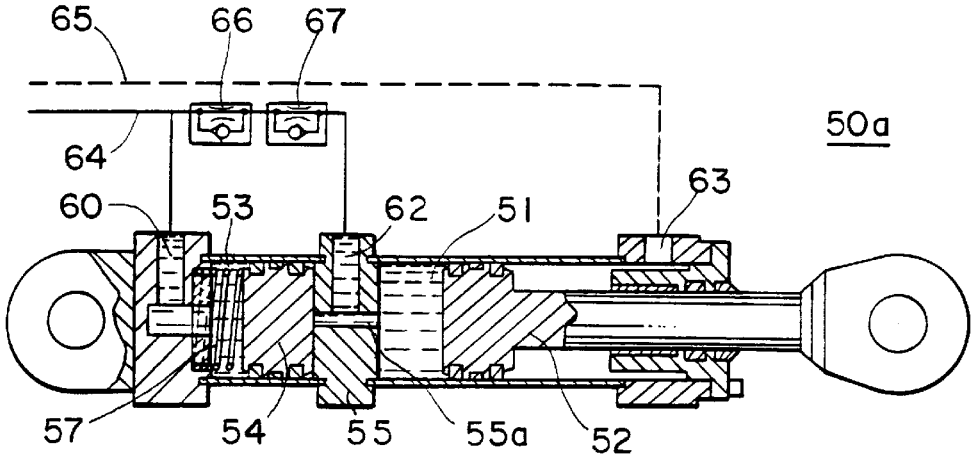
Figure 4C:
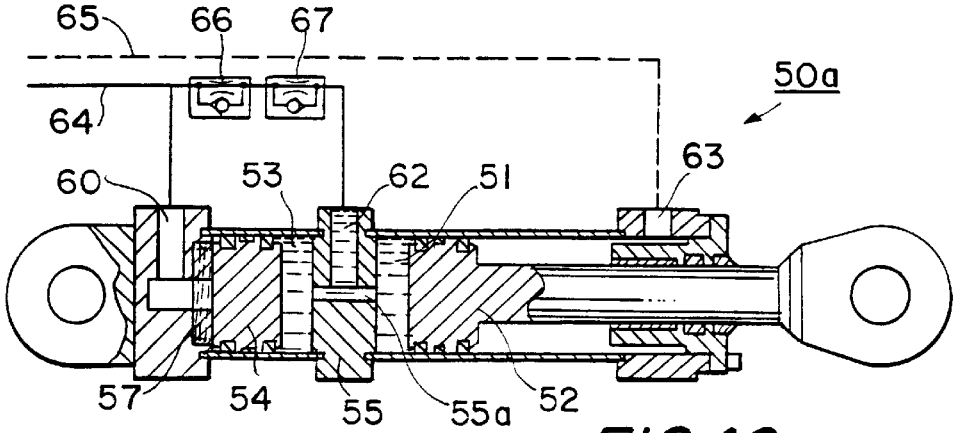

In the construction of FIGS. 3A–3C, the measuring cylinder 53 is placed directly in connection with the cylinder part 51, but it can also be placed apart from the cylinder part, since with regard to operation, a mechanical connection between the piston 54 of the measuring cylinder and the piston 52 of the cylinder part is not necessary. Such arrangements have been illustrated by way of example in FIGS. 4A–4C and 5A–5C. The numbering of these drawings corresponds to the numbering of FIGS. 3A–3C insofar as the constructions correspond to each other. In FIGS. 4A–4C, however, the hydraulic cylinder is denoted generally by reference numeral 50*a* and in FIGS. 5A–5C by reference numeral 50*b*.

The hydraulic cylinder 50*a* shown in FIGS. 4A–4C largely corresponds in structure to the structure shown in FIGS. 3A–3C whereby in the arrangement of FIGS. 4A–4C, a measuring cylinder 53 is placed directly as an extension of a cylinder part 51. In the structure shown in FIGS. 4A–4C, a partition wall 55, however, cuts off the mechanical connection between a piston 52 of the cylinder part and a cylinder 54 of the measuring cylinder, while a connecting duct 55*a* is formed into the partition wall 55 so as to extend therethrough so that the cylinder part 51 and the measuring cylinder 53 are in hydraulic connection with each other. A pressure connection 62 opens into the connecting duct 55*a*. The operation of the hydraulic cylinder 50*a* is equivalent to that already explained in connection with FIGS. 3A–3C.

In the position depicted in FIG. 4A, the hydraulic cylinder 50*a* is unpressurized. An external force acting on the arm of the piston 52 in the cylinder part 51 presses the piston 52 against the partition wall 55 and, in a similar way, a spring means 57 mounted at the bottom of the measuring cylinder 53 presses the piston 54 of the measuring cylinder against the partition wall 55. When hydraulic oil is supplied from a pressure duct 64 into the hydraulic cylinder through pressure connections 60 and 62, the piston 54 of the measuring cylinder remains in the position shown in FIG. 4B against the partition wall 55 and the piston 52 of the cylinder part 51 moves to the position of FIG. 4B. The piston 54 of the measuring cylinder remains in place for the reason that the same pressure prevails on both sides of the piston and the effective area below the piston 54 of the measuring cylinder is considerably larger than on the side of the partition wall 55. Thus, the hydraulic cylinder 50*a* is shown in FIG. 4B in a position corresponding to that of FIG. 3B and in this regard, reference is made to the description in connection with FIG. 3B.

Figure 5A:
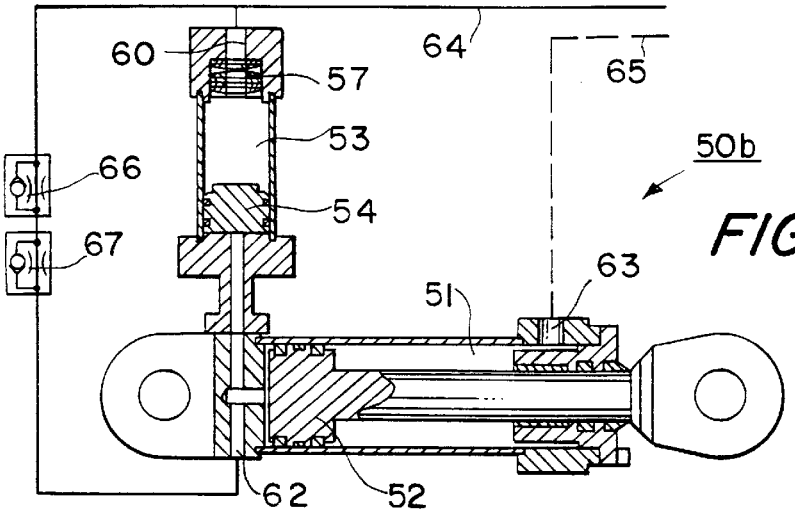
Figure 5B:
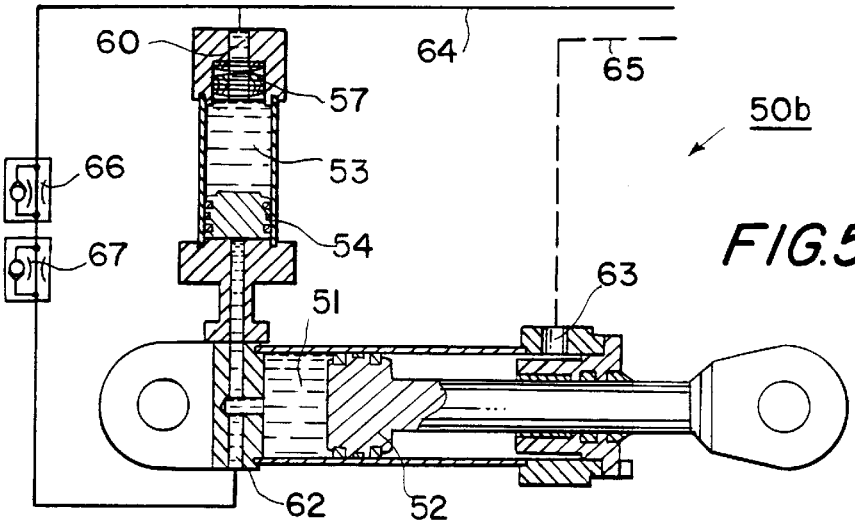
Figure 5C:
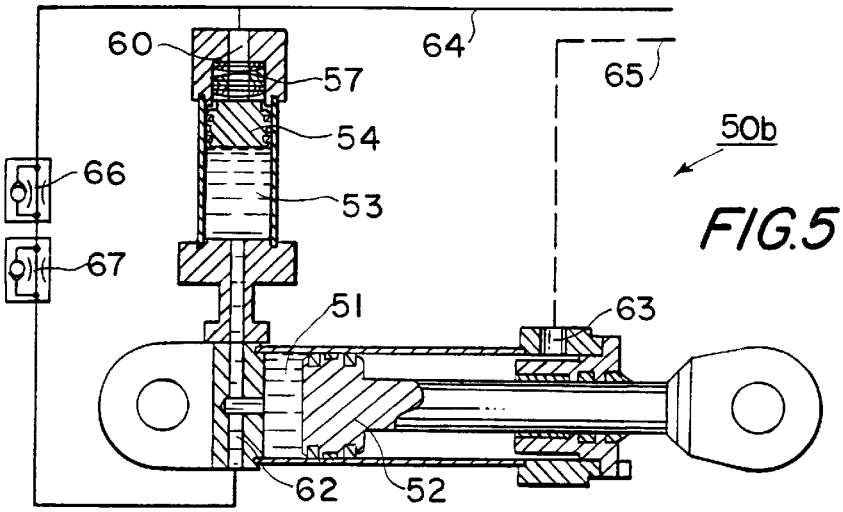

In FIG. 4C, the hydraulic cylinder 50*a* is shown in a situation corresponding to that of FIG. 3C. In that case, the control pressure prevailing in the pressure duct 64 has been removed, and the pressure below the piston 52 of the cylinder part 51 and prevailing in the connecting duct 55*a* has pressed the piston 54 of the measuring cylinder to the bottom of the measuring cylinder. In other respects, especially regarding the operation of valves 66,67, reference is made to the description already provided in connection with FIG. 3C. If the pressure is discharged totally out from the cylinder part 51, the piston 52 is first pressed to the bottom of the cylinder part 51 against the partition wall 55 and, after that, the spring means 57 pushes the piston 54 of the measuring cylinder from the other side against the partition wall 55. This, then, is the situation shown in FIG. 4A. FIGS. 5A–5C depict a further embodiment of a hydraulic cylinder 50*b*, which is in operation identical with the arrangement shown in FIGS. 4A–4C. Also in structure, the arrangement of FIGS. 5A–5C differs from that of FIGS. 4A–4C only in the respect that the measuring cylinder 53 in this embodiment is not directly an axial extension of the cylinder part 51, but, instead,the measuring cylinder 53 is turned so as ring so as to be at an angle relative to the cylinder 51, this angle being about 90° in FIGS. 5A–5C. Regarding the operation of this application, reference is made to the description provided above in connection with FIGS. 3A–3C and 4A–4C.

The movements of the hydraulic cylinder illustrated in FIGS. 3A–3C, 4A–4C and 5A–5C can also be easily provided with different movement velocities. A desired return movement from a working position may be determined for the cylinder. In operation, this kind of cylinder is suitable especially for a place where the length of the cylinder in working position varies from time to time and it is, however, desired that the piston of the cylinder shall move specifically a desired distance in a direction away from the working position. This kind of operation is needed, in addition to the relief cylinders of the calender in accordance with the invention, in a working cylinder of a brake, where the length of the working position of the cylinder changes with the wearing down of the brake material and, nevertheless, it is possible to provide, after the braking has stopped, a clearance of constant magnitude for the brake in order to prevent dragging. This property has been achieved by passing the oil discharging from the cylinder during a return movement to a special measuring cylinder. The length of the return movement of the cylinder can be affected in a desired manner by means of the diameter and the length of the measuring cylinder.

The examples provided above are not meant to be exclusive. Many other variations of the present invention would be obvious to those skilled in the art, and are contemplated to be within the scope of the appended claims.

We claim:

1. A method for quick-opening a set of rolls in a calender including calendering nips through which a paper or board web to be calendered is passed, the calendering nips being formed by a variable-crown upper roll, a variable-crown lower roll and at least two intermediate rolls arranged between the upper and lower rolls, the upper roll, the lower roll and the intermediate rolls being arranged to form a substantially vertical stack of rolls, the intermediate rolls being supported by relief cylinders pressurized by hydraulic fluid so as to relieve the nip load produced by the mass of bearing housings of the intermediate rolls and auxiliary devices associated therewith, whereby during the quick-opening of the set of rolls, the lower roll is lowered and the relief pressures in the relief cylinders are at least partially discharged to open the calendering nips, the method comprising the steps of:

connecting valves to the relief cylinders of the intermediate rolls, each of said valves having a flow passage through which hydraulic fluid flows, and operating said valves to control the flow of hydraulic fluid from the relief cylinders through said flow passages in said valves to thereby discharge the relief pressures in the relief cylinders and such that the calendering nips are opened in a controlled manner and in a desired order during quick-opening of the set of rolls.

2. The method of claim 1, wherein the step of operating said valves comprises the step of opening all of said valves substantially simultaneously such that hydraulic fluid from the relief cylinders flows through said flow passages in all of said valves.

3. The method of claim 1, wherein the step of operating said valves comprises the steps of:

controlling the flow of hydraulic fluid through said flow passages in said valves such that the hydraulic fluid flows in a path downward from each of the intermediate rolls to the intermediate rolls situated below that intermediate roll, and varying the flow resistance of the hydraulic fluid from the relief cylinders of the intermediate rolls such that the flow resistance of the hydraulic fluid from the relief cylinder supporting an uppermost one of the intermediate rolls is the highest and the flow resistance of the hydraulic fluid from the relief cylinders supporting the remaining ones of the intermediate rolls decreases for each of the intermediate rolls below the uppermost intermediate roll, the flow resistance of the hydraulic fluid from the relief cylinder supporting the lowermost one of the intermediate rolls being the lowest.

4. The method of claim 1, wherein the step of operating said valves comprises the step of:

controlling the flow of hydraulic fluid through said valves such that the hydraulic fluid flows in a path downward from one of said valves associated with each of the intermediate rolls through other of said valves associated with other ones of the intermediate rolls situated below that intermediate roll during quick-opening of the set of rolls such that the pressure of the relief cylinder supporting an uppermost one of the intermediate rolls is discharged through all of said valves and the pressure of the relief cylinder supporting a lowermost one of the intermediate rolls is discharged only through its own valve.

5. The method of claim 1, further comprising the step of:

directing a hydraulic fluid through a control valve to all of said valves of the relief cylinders of the intermediate rolls to provide a control impulse simultaneously to all of said valves of the relief cylinders of the intermediate rolls in order to hydraulically control said valves of the relief cylinders of the intermediate rolls.

6. The method of claim 1, further comprising the steps of:

arranging a movable piston in each of the relief cylinders, coupling an end of each of said pistons to an arm supporting a bearing housing of one of the intermediate rolls such that movement of said piston translates into movement of the intermediate rolls, and slowing and optionally stopping movement of said pistons in the relief cylinders during quick-opening of the set of rolls once a desired quick-opening distance has been reached.

7. The method of claim 6, further comprising the step of:

controlling the movement of said pistons of the relief cylinders by providing each of said pistons with a measuring cylinder connected to a cylinder part.

8. In a hydraulic system for a set of rolls in a calender including a variable-crown upper roll, a variable-crown lower roll and at least two intermediate rolls arranged between the upper roll and the lower roll, the upper roll, the lower roll and the intermediate rolls being arranged to form a substantially vertical stack of rolls in which adjacent rolls placed one above another are in nip contact with one another and form calendering nips therebetween, the intermediate rolls being provided with relief cylinders for relieving a nip load produced by the mass of bearing housings of the intermediate rolls and auxiliary devices associated therewith, the improvement comprising valves for supplying hydraulic fluid to the relief cylinders under a desired pressure during operation which depends on the load acting on each of the relief cylinders, said valves being structured and arranged to discharge the hydraulic pressure from the relief cylinders during quick-opening of the set of rolls when a lowermost roll in the stack of rolls is lowered, and control means associated with said valves for controlling the discharge of hydraulic pressure from the relief cylinders through said valves such that the hydraulic pressure is discharged from the relief cylinders in a controlled manner and the calendering nips in the set of rolls open in a desired order.

9. The hydraulic system of claim 8, wherein a portion of the intermediate rolls have a take-out roll situated on the inside relative to a calender frame supporting the calender and another portion of the intermediate rolls have a take-out roll situated on the outside relative to the calender frame, further comprising a first pressure circuit connected to the relief cylinders of the intermediate rolls having the take-out roll situated on the inside relative to the calender frame, said first pressure circuit supplying hydraulic fluid to these intermediate rolls through some of said valves, a second pressure circuit connected to the relief cylinders of the intermediate rolls having the take-out roll situated on the outside relative to the calender frame, said second pressure circuit supplying hydraulic fluid to these intermediate rolls through some of said valves, a third pressure circuit connected to the relief cylinder of a drive roll of the calender which is the lowermost one of the intermediate rolls, said third pressure circuit supplying hydraulic fluid to the lowermost intermediate roll through one of said valves, and a fourth pressure circuit for supplying each of the relief cylinders with a counterpressure of equal magnitude acting in a direction opposite to the relief pressure.

10. The hydraulic system of claim 8, wherein said valves are arranged to discharge the relief pressure acting in the relief cylinders substantially simultaneously when the set of rolls is opened quickly.

11. The hydraulic system of claim 8, wherein said valves are arranged such that the resistance to the flow of hydraulic fluid from the relief cylinders through flow passages in said valves is variable.

12. The hydraulic system of claim 11, wherein said valves are arranged such that the flow resistance of the hydraulic fluid flowing out from the relief cylinder supporting an uppermost one of the intermediate rolls is the highest and the flow resistance of the hydraulic fluid flowing out from the relief cylinder supporting a lowermost one of the relief cylinders is the lowest, the flow resistance being stepwise reduced in the direction from the relief cylinder supporting the uppermost intermediate roll to the relief cylinder supporting the lowermost intermediate roll.

13. The hydraulic system of claim 8, wherein said valves are connected in series such that the hydraulic fluid flowing out from each of the relief cylinders supporting a respective one of the intermediate rolls passes through one of said valves associated with that relief cylinder and other of said valves associated with any relief cylinders supporting intermediate rolls situated below that intermediate roll when the set of rolls is opened quickly, whereby the hydraulic fluid flowing out from the relief cylinders supporting an uppermost one of the intermediate rolls passes through all of said valves and the hydraulic fluid flowing out from the relief cylinders supporting a lowermost one of the intermediate rolls passes only through its own valve.

14. The hydraulic system of claim 8, wherein said valves are hydraulically controlled valves, further comprising a control valve for supplying a control pressure to all of said valves.

15. The hydraulic system of claim 8, further comprising a hydraulic fluid reservoir and a pressure circuit through which the hydraulic fluid flows, said pressure circuit being arranged to supply a counterpressure to the relief cylinders in order to ensure a supply of hydraulic fluid to the relief cylinders in a quick-opening situation.

16. The hydraulic system of claim 8, wherein the relief cylinders are three-position hydraulic cylinders including a first movable piston and structured and arranged such that the movement of said first piston is stopped or at least highly decelerated during quick-opening of the set of rolls after a desired quick-opening distance has been reached.

17. The hydraulic system of claim 16, wherein each of said hydraulic cylinders includes a measuring cylinder for controlling the movement of said first piston during quick-opening.

18. The hydraulic system of claim 17, wherein each of said hydraulic cylinders further includes a second movable piston arranged in said measuring cylinder, said second piston being movable into connection with said first piston.

19. The hydraulic system of claim 18, wherein said first pistons and said second pistons are in direct hydraulic connection with each other.

20. The hydraulic system of claim 8, wherein the relief cylinders each comprise a cylinder part defining a substantially cylindrical interior, a first piston arranged in said cylindrical interior of said cylinder part, a measuring cylinder defining a substantially cylindrical interior, a partition wall for separating said measuring cylinder from said cylinder part, and a second piston arranged in said cylindrical interior of said measuring cylinder.

* * * * *